US007175540B2

(12) United States Patent
Sano

(10) Patent No.: US 7,175,540 B2
(45) Date of Patent: Feb. 13, 2007

(54) GOLF PUTTER

(75) Inventor: Yoshinori Sano, Kobe (JP)

(73) Assignee: SRI Sports Limited, Kobe (JP)

( * ) Notice: Subject to any disclaimer, the term of this patent is extended or adjusted under 35 U.S.C. 154(b) by 95 days.

(21) Appl. No.: 10/945,922

(22) Filed: Sep. 22, 2004

(65) Prior Publication Data

US 2005/0090328 A1 Apr. 28, 2005

(30) Foreign Application Priority Data

Oct. 22, 2003 (JP) ..... 2003-362211

(51) Int. Cl.
*A63B 53/04* (2006.01)

(52) U.S. Cl. ..... 473/332; 473/340; 473/342; 473/349

(58) Field of Classification Search ..... 473/332, 473/342, 349, 340–341, 329, 350
See application file for complete search history.

(56) References Cited

U.S. PATENT DOCUMENTS 4,422,638 A * 12/1983 Tucker ..... 473/329
5,405,136 A * 4/1995 Hardman ..... 473/342
5,766,093 A * 6/1998 Rohrer ..... 473/329
6,001,030 A * 12/1999 Delaney ..... 473/329
6,007,434 A * 12/1999 Baker et al. ..... 473/330
6,273,831 B1 8/2001 Dewanjee
6,302,807 B1 * 10/2001 Rohrer ..... 473/329
6,375,583 B1 4/2002 Solheim
6,860,822 B2 * 3/2005 Vrska, Jr. ..... 473/324

FOREIGN PATENT DOCUMENTS

GB 2338903 * 12/2000
JP 2003-777 A 1/2003

* cited by examiner

*Primary Examiner*—Sebastiano Passaniti
(74) *Attorney, Agent, or Firm*—Birch, Stewart, Kolasch & Birch, LLP

(57) ABSTRACT

In a golf putter including a putter head including a head body formed from a metal, and a face insert formed from an elastic material and fixed in a putter face of the head body, the face insert includes a varied thickness portion increased in thickness from a zone adjacent a sweet spot of the head toward circumferential edges of the face insert.

13 Claims, 9 Drawing Sheets

GOLF PUTTER

This Non-provisional application claims priority under 35 U.S.C. § 119(a) on Patent Application No(s). 2003-362211 filed in Japan on Oct. 22, 2003, the entire contents of which are hereby incorporated by reference.

BACKGROUND OF THE INVENTION

1. Field of the Invention

The present invention relates to a golf putter provided with a head including a face insert.

2. Description of the Prior Art

Putter heads for use in golf putters include one which is formed from a single metal, and one which includes a face insert fixed in a putter face thereof. The latter putter head aims at improving "hit feel" and the like by fixing the face insert in the putter face at a striking position.

Metals or elastic materials such as resins are used as a material of the face insert. The face inserts formed from the elastic materials such as resins, in particular, are widely used because the elastic materials have lower hardness and modulus of elasticity than metals, thus providing a softer hit feel.

As a putter head using the elastic material such as a resin for forming the face insert, there has been proposed a putter head employing a face insert of urethane resin, for example (Japanese Unexamined Patent Publication No.2001-129136 and Japanese Unexamined Patent Publication No.2002-200203).

There is also known a putter head employing a face insert of polyamide resin (see Japanese Unexamined Patent Publication No.2003-777).

SUMMARY OF THE INVENTION

In a case where a golf ball is struck by way of a putter provided with a metal putter head free from a face insert or a putter head including a metal face insert, a hit feel upon impact on a zone adjacent a sweet spot differs less from a hit feel upon impact on place away from the zone adjacent the sweet spot. With a face insert formed from an elastic material such as a resin, on the other hand, there is a relatively great difference between a hit feel upon impact on the zone adjacent the sweet spot and a hit feel upon impact on place away from the zone adjacent the sweet spot.

The reason is as follows. A ball hitting against the zone adjacent the sweet spot causes little rotation of the head, whereas a ball hitting against place away from the zone adjacent the sweet spot applies a relatively great moment to the head, the moment great enough to cause the rotation of the head. Thus, the head is prone to motions including rotation, vibration and the like. Such different behaviors of the head delicately affect the hit feel to a golfer, resulting in the difference of the hit feels. In a case where a ball is struck with a putter, in particular, the ball hitting against the zone adjacent the sweet spot produces a relatively soft hit feel, whereas the ball hitting against place away from the zone adjacent the sweet spot produces a relatively hard hit feel.

In the case of the putter head free from the face insert or including the metal face insert, the ball hitting against any place on a putter face produces a relatively hard hit feel because the putter face is formed from a relatively hard material. Accordingly, there is less difference of the hit feels.

In the case of a face insert formed from an elastic material such as a resin, on the other hand, the face insert has an effect to provide a soft hit feel. Because of synergy between the effect of the insert material and an effect of the striking position, the ball hitting against the zone adjacent the sweet spot provides quite a soft hit feel to the player. On the other hand, the ball hitting against place away from the zone adjacent the sweet spot also provides a relatively soft hit feel to the player by virtue of the effect of the insert material. However, the aforesaid synergetic effects contribute to a much softer hit feel upon impact on the zone adjacent the sweet spot and hence, the difference between the hit feel upon impact on the zone adjacent the sweet spot and the hit feel upon impact on place away from the zone adjacent the sweet spot becomes greater as compared with the case where the head with the aforesaid metal insert is used. The hit feel becomes harder as the impact point is spaced farther away from the zone adjacent the sweet spot. Thus, differences among individual hit feels related to individual impact points on the putter face are made obvious by providing the face insert of the elastic material such as a resin.

In this manner, the hit feel becomes harder as the impact point is spaced farther away from the sweet spot. In this case, however, the player mistakes such a harder hit feel as a hit feel resulting from a stronger strike than intended and hence, the player tries to adjust a roll distance of a putted ball by, for example, making a smaller follow-through motion (or by taking a roll distance control action). This leads to a tendency that the player fails to achieve a desired roll distance of the putted ball which does not reach a cup (a so-called short roll).

A ball hitting against place farther away from the zone adjacent the sweet spot has a lower restituition coefficient than a ball hitting against the zone adjacent the sweet spot, while the restituition coefficient is decreased further as the distance between the impact point and the sweet spot increases. Therefore, the ball hitting against place away from the zone adjacent the sweet spot tends to roll short even though the aforementioned distance control action by the player is set aside. When the aforementioned distance control action taken by the player is added, the probability of the aforesaid short roll is further increased.

Thus, the face insert formed from the elastic material involves a problem that the player is more likely to have an erroneous sense of roll distance as the impact point is spaced farther away from the sweet spot.

The invention has been accomplished in view of the foregoing problem. It is an object of the invention to provide a golf putter which includes the face insert of the elastic material fixed in the putter face and which provides easy adaptation of the sense of roll distance by reducing the differences among the hit feels upon impact on places of different distances from the sweet spot.

The golf putter according to the invention comprises a putter head including: a head body formed from a metal; and a face insert which is formed from an elastic material and fixed in a putter face of the head body, and which includes a varied thickness portion increased in thickness from a zone adjacent a sweet spot to circumferential edges of the face insert.

In the varied thickness portion of the face insert configured in this manner, the thickness is decreased toward the zone adjacent the sweet spot, whereas the thickness is increased toward the circumferential edges of the face insert. Therefore, the difference of hit feels related to impact points of different distances from the sweet spot is cancelled by the difference of the thicknesses of the insert. As a result, the hit feels related to the different impact points are leveled off.

It is noted that the "zone adjacent the sweet spot" means an area extending 5 mm or less from the sweet spot on the putter face.

The "elastic material" includes resins as well as rubbers and polymer materials such as elastomers.

According to the above putter, the face insert may preferably be positioned to include at least a part of the zone adjacent the sweet spot, and include a minimum thickness point, as the thinnest part thereof, in the zone adjacent the sweet spot, whereas the varied thickness portion may preferably be varied in thickness along a toe-heel direction of the face insert. In this case, the minimum thickness point is located in the zone adjacent the sweet spot, from which the softest hit feel tends to be communicated to the player upon impact with the ball. Hence, the degree of softness of the hit feel upon impact on the zone adjacent the sweet spot is reduced so that the difference between the hit feel upon impact on the zone adjacent the sweet spot and the hit feel upon impact on place away therefrom is decreased. Consequently, the effect to level off the different hit feels, which is the result of providing the varied thickness portion, is enhanced quite dramatically. Since the varied thickness portion is varied in thickness along the toe-heel direction, the different hit feels may be leveled off in correspondence to the shift of the impact point along the toe-heel direction.

In addition to the thickness variations along the toe-heel direction, the thickness variations may also be provided in the varied thickness portion along a top-sole direction of the face insert. In this case, the different hit feels may be leveled off in correspondence to the shift of the impact point along the top-sole direction.

In the varied thickness portion varied in thickness along the toe-heel direction, values of (t2/t1) and (t3/t1) may preferably be 1.2 or more and 11 or less; more preferably 1.5 or more and 5 or less; or particularly preferably 2 or more and 3 or less, provided that t1 indicates a thickness at the minimum thickness point, t2 indicating a thickness at a point 20 mm toward the toe from the minimum thickness point, t3 indicating a thickness at a point 20 mm toward the heel from the minimum thickness point. If the values are too small, the amount of thickness variation is so small that the effect resulting from the provision of the varied thickness portion may be decreased. What is worse, the thickness (absolute value) at the minimum thickness point is too small and hence, the face insert may suffer an insufficient strength or the hit feel upon impact on the minimum thickness point may become hard. If the values are too great, on the other hand, the thickness (absolute value) at the point 20 mm toward the toe or heel is too great and hence, the degree of freedom of head design may be lowered or the head may have an excessively large size so as to suffer an overweight.

In the varied thickness portion varied in thickness along the top-sole direction, values of (t4/t1) and (t5/t1) may preferably be 1.1 or more and 3 or less; more preferably 1.2 or more and 3 or less; or particularly preferably 1.2 or more and 2.5 or less, provided that t1 indicates a thickness at the minimum thickness point, t4 indicating a thickness at a point 5 mm toward the top from the minimum thickness point, t5 indicating a thickness at a point 5 mm toward the sole from the minimum thickness point. If these values are too small, the amount of thickness variation is so small that the effect to level off the different hit feels in correspondence to the shift of the impact point toward the top or sole from the zone adjacent the sweet spot may be decreased. If these values are too great, on the other hand, the thickness t1 at the minimum thickness point may become too small, or the thickness t4 or t5 may become too great, just as in the aforementioned cases of the values (t2/t1) and (t3/t1).

The face insert may preferably have a JIS-A hardness of 88 to 96. If the face insert has a hardness in this range, the effect resulting from the provision of the varied thickness portion is enhanced even further, while there may be obtained a moderately soft hit feel.

The JIS-A hardness means hardness measured with a spring-type A hardness meter according to JIS K 6301.

According to the invention, the putter including the insert formed from the elastic material is arranged such that the varied thickness portion is provided which is increased in thickness from the zone adjacent the sweet spot toward the circumferential edges of the face insert. Therefore, the invention provides the putter adapted to level off the different hit feels related to the different impact points, so as to provide easy adaptation of the sense of roll distance.

DESCRIPTION OF THE PREFERRED EMBODIMENTS

Figure 1:
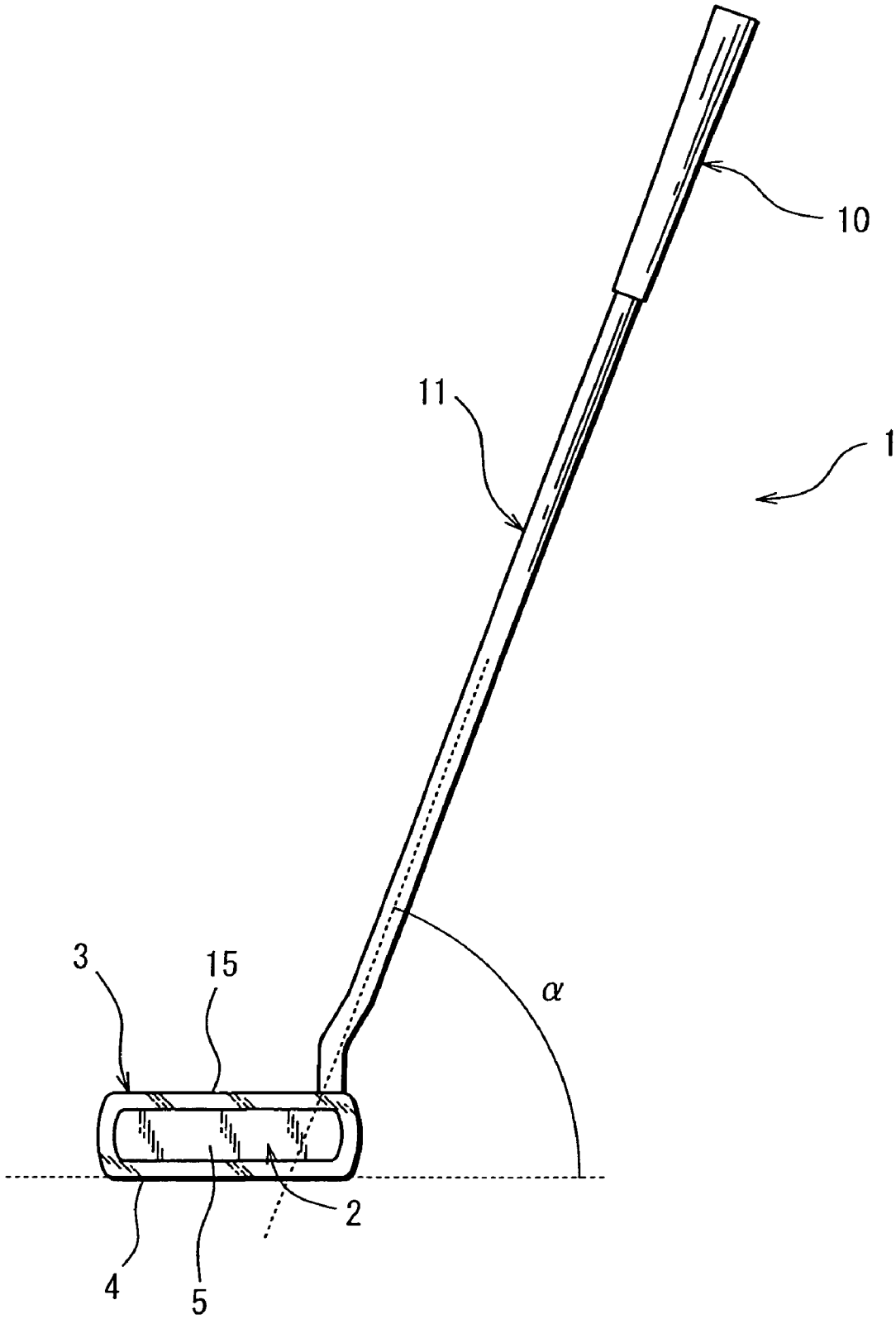
FIG. 1 is a general view of a golf putter according to one embodiment of the invention.

An embodiment of the invention will hereinbelow be described with reference to the accompanying drawings. FIG. 1 is a general view showing a golf putter 1 according to one embodiment of the invention. The golf putter 1 includes: a head 3 including a putter face 2 for striking a ball; a grip 10 defining a portion on which a player holds the golf putter during putting; and a substantially bar-shaped shaft 11 having the head 3 fixed to one end thereof and the grip 10 mounted to the other end thereof.

While a major part of the shaft 11 is in the form of a straight bar, the shaft is bent only at a portion near the aforesaid one end to which the head 3 is fixed. The bent is provided for the purpose of imparting a proper lie angle or the like to the golf putter 1. A detailed description on this respect will be made hereinlater.

Figure 2:
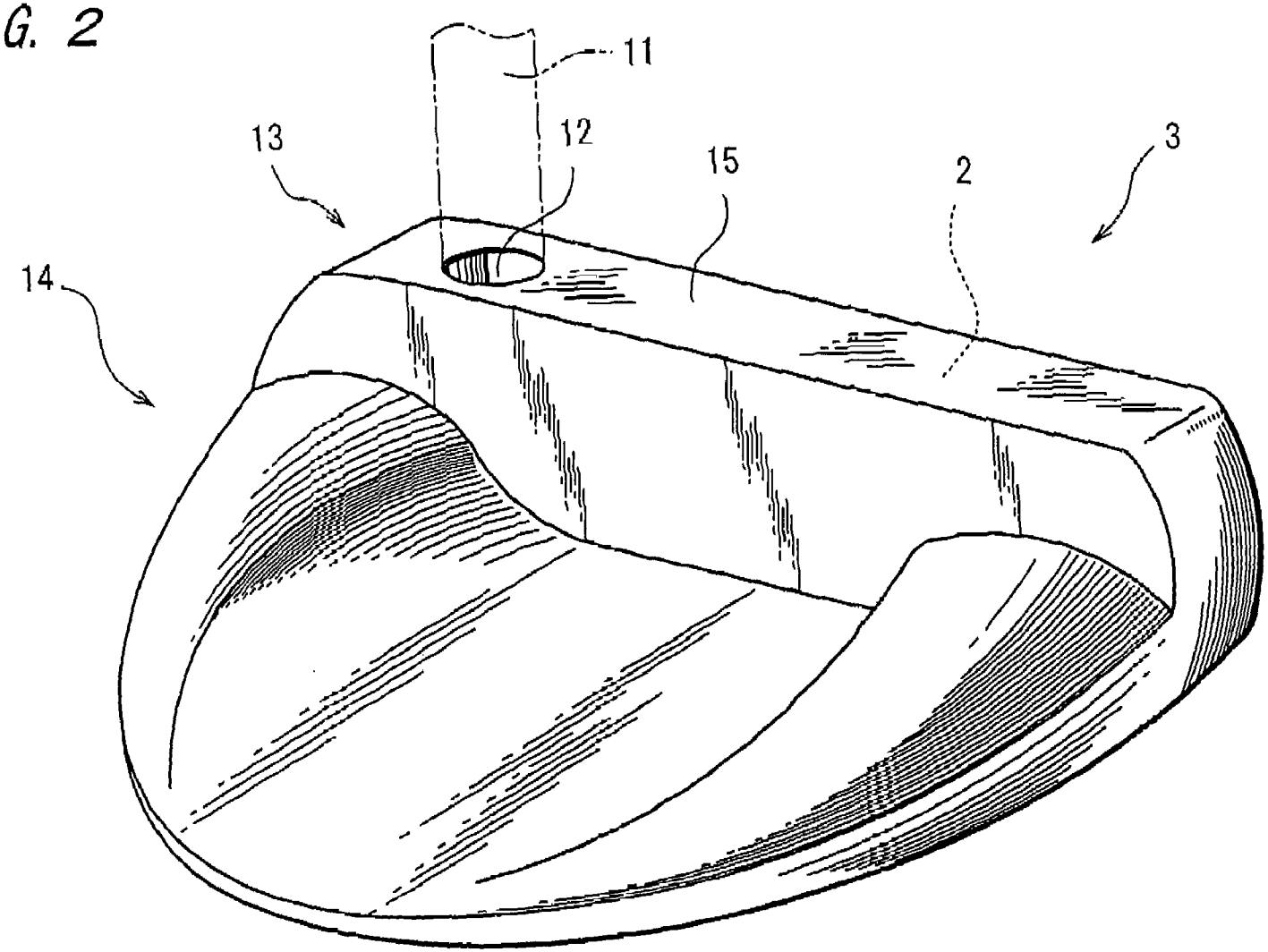
FIG. 2 is a perspective view showing a head of the golf putter of FIG. 1.
Figure 3:
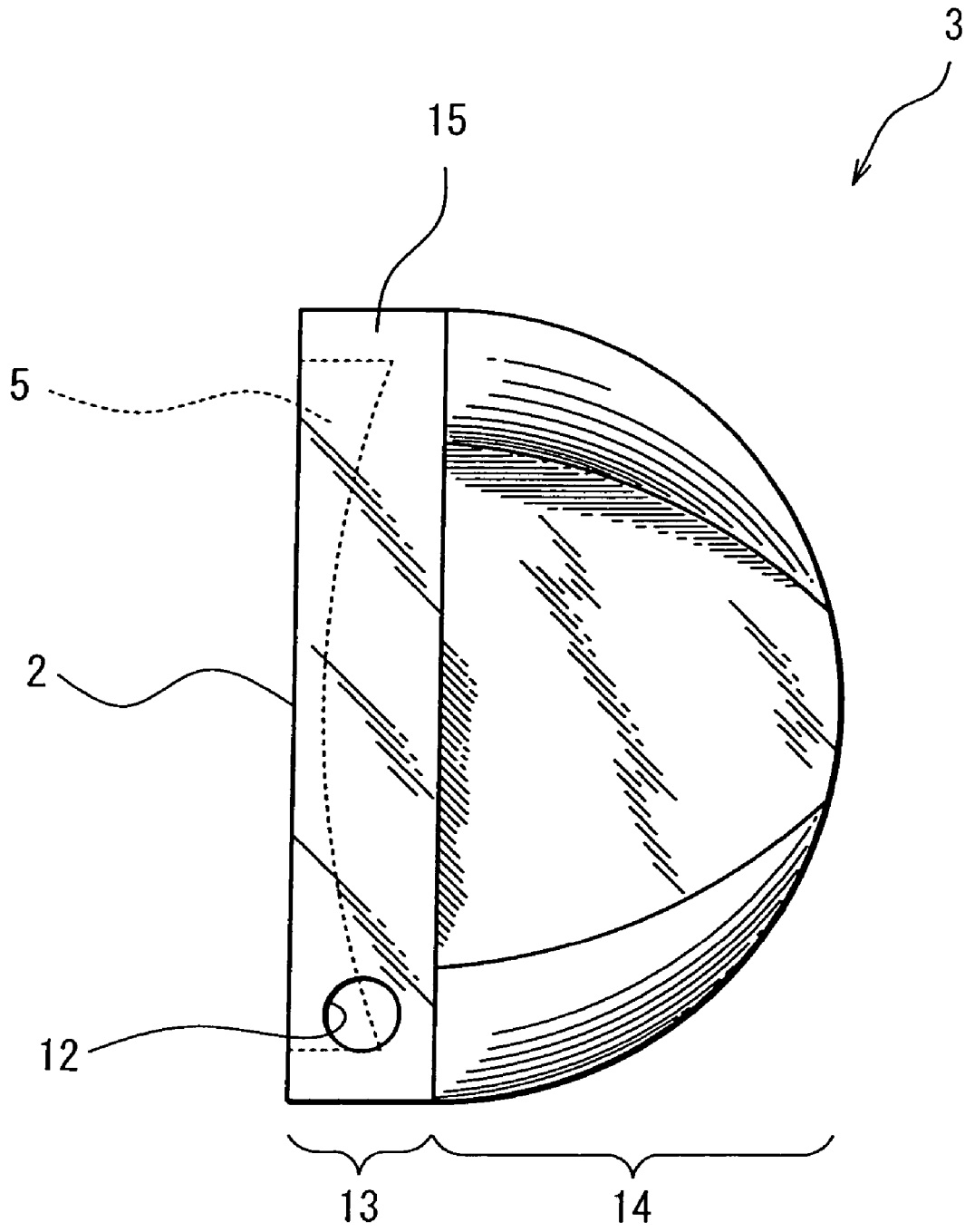
FIG. 3 is a plan view of the head of FIG. 2 as viewed from a top side.

FIG. 2 is a perspective view showing the head 3. FIG. 3 is a plan view of the head 3 as viewed from a top side (upper side) thereof, whereas FIG. 4 is a view of the head 3 as viewed from a putter-face 2 side thereof.

The head 3 includes the putter face 2 defined by a flat surface to strike the ball. The putter face 2 has a face insert 5 fixed therein, the face insert formed from an elastic material such as a resin. The head 3 includes the face insert 5, and a head body h formed from a metal.

Figure 4:
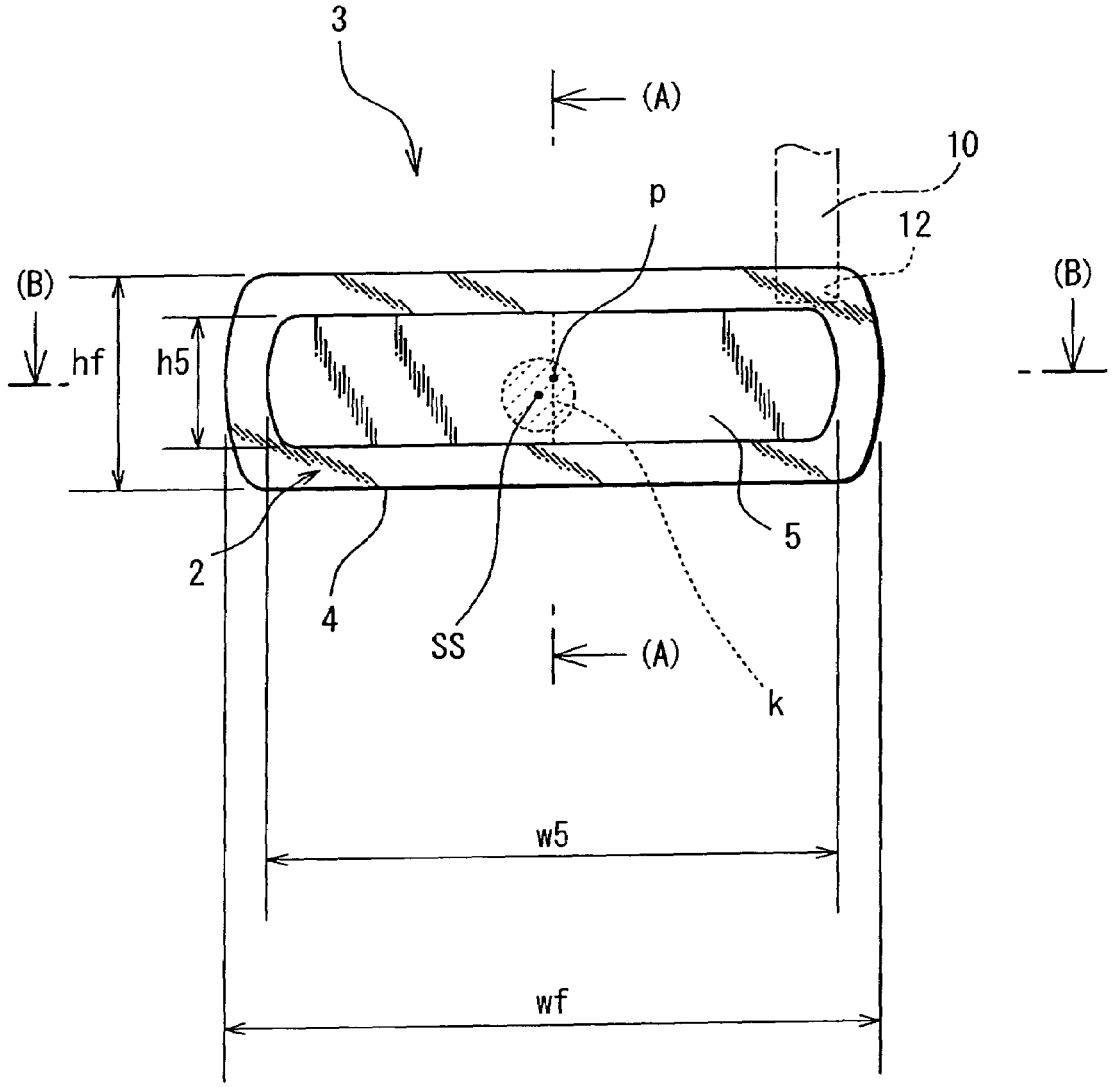
FIG. 4 is a plan view of the head of FIG. 2 as viewed from a putter face side.

As shown in FIG. 4, a profile of the face insert 5 as seen on the surface of the putter face 2 is similar to a profile of the putter face 2 of the head 3 (head body h) and is one size smaller than the profile of the putter face 2. The face insert 5 is located in the putter face 2 substantially at the center thereof. Thus, the face insert 5 constitutes a central portion of the putter face 2 but for a marginal portion thereof.

As shown in FIG. 4, the head body h includes a sole face 4 defining a bottom of the head 3, and a shaft hole 12 having a circular section, which receives the shaft 11 therein and is bonded to the shaft 11 at an inner periphery thereof.

As shown in FIG. 2 and FIG. 3, the head body h is divided into two major parts which include: a front portion 13 formed of a thick plate located on the putter-face 2 side and in substantially parallel relation with the putter face 2; and a rear portion 14 accounting for the other part than the front portion 13 and constituting a back-side part of the head 3. The rear portion 14 is thicker at toe-side and heel-side portions thereof than at a central portion thereof with respect to the toe-heel direction thereof. Thus, the rear portion constitutes the golf putter 1 of a so-called toe-heel balance configuration wherein a relatively greater weight is concentrated on the toe-side and the heel side. An upper side of the front portion 13 defines a top face 15.

Formed at place near the heel side of the front portion 13 is the shaft hole 12, an axis of which is substantially perpendicular to the sole face 4. When the straight shaft 11 is fixed in the shaft hole 12, the golf putter 1 has a lie angle of about 90°, which significantly differs from a common lie angle of the putter. As described in the foregoing, therefore, the fixing end of the shaft 11 is properly bent in order to define a proper lie angle for the golf putter 1 as well as to allow for adjustment of real loft angle, face progression or the like of the putter.

Figure 5:
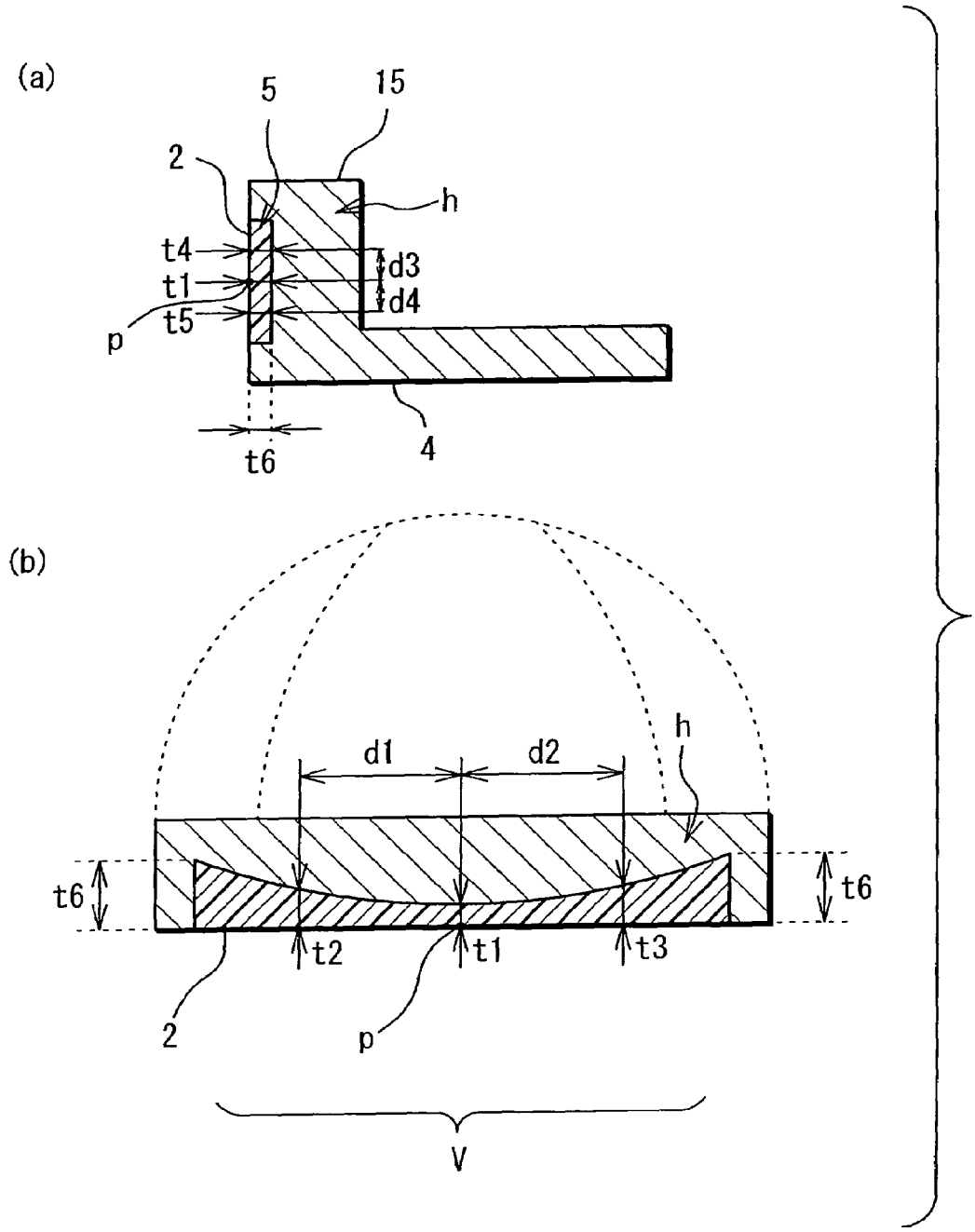
FIG. 5(*a*) is a sectional view of a head according to a first embodiment of the invention taken on the line A—A in FIG. 4, FIG. 5(*b*) representing a sectional view taken on the line B—B in FIG. 4.

FIG. 5(*a*) is a sectional view of the head 3 taken on the line A—A in FIG. 4, whereas FIG. 5(*b*) is a sectional view of the head 3 taken on the line B—B in FIG. 4. A cavity configured in conformity with the configuration of the face insert 5 is formed in the putter face 2 of the head body h. The face insert 5 is fixedly fitted in the cavity. The face insert 5 and the head body h jointly form a substantially flat surface on the putter-face side, which defines the putter face 2.

Figure 6:
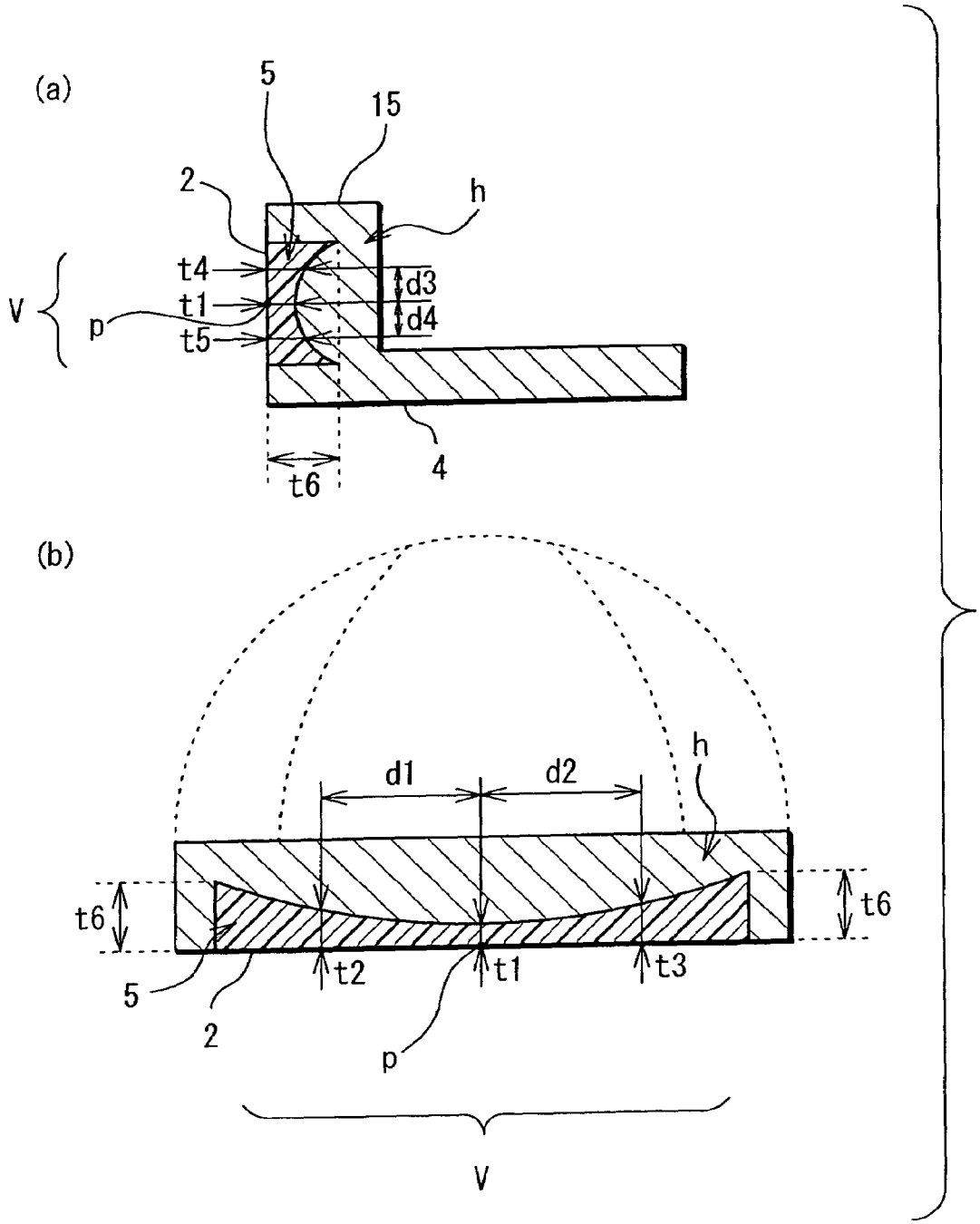
FIG. 6 is a group of sectional views showing a head of a golf putter according to a second embodiment of the invention, FIG. 6(*a*) representing a sectional view taken on the line A—A in FIG. 4, FIG. 6(*b*) representing a sectional view taken on the line B—B in FIG. 4.
Figure 7:
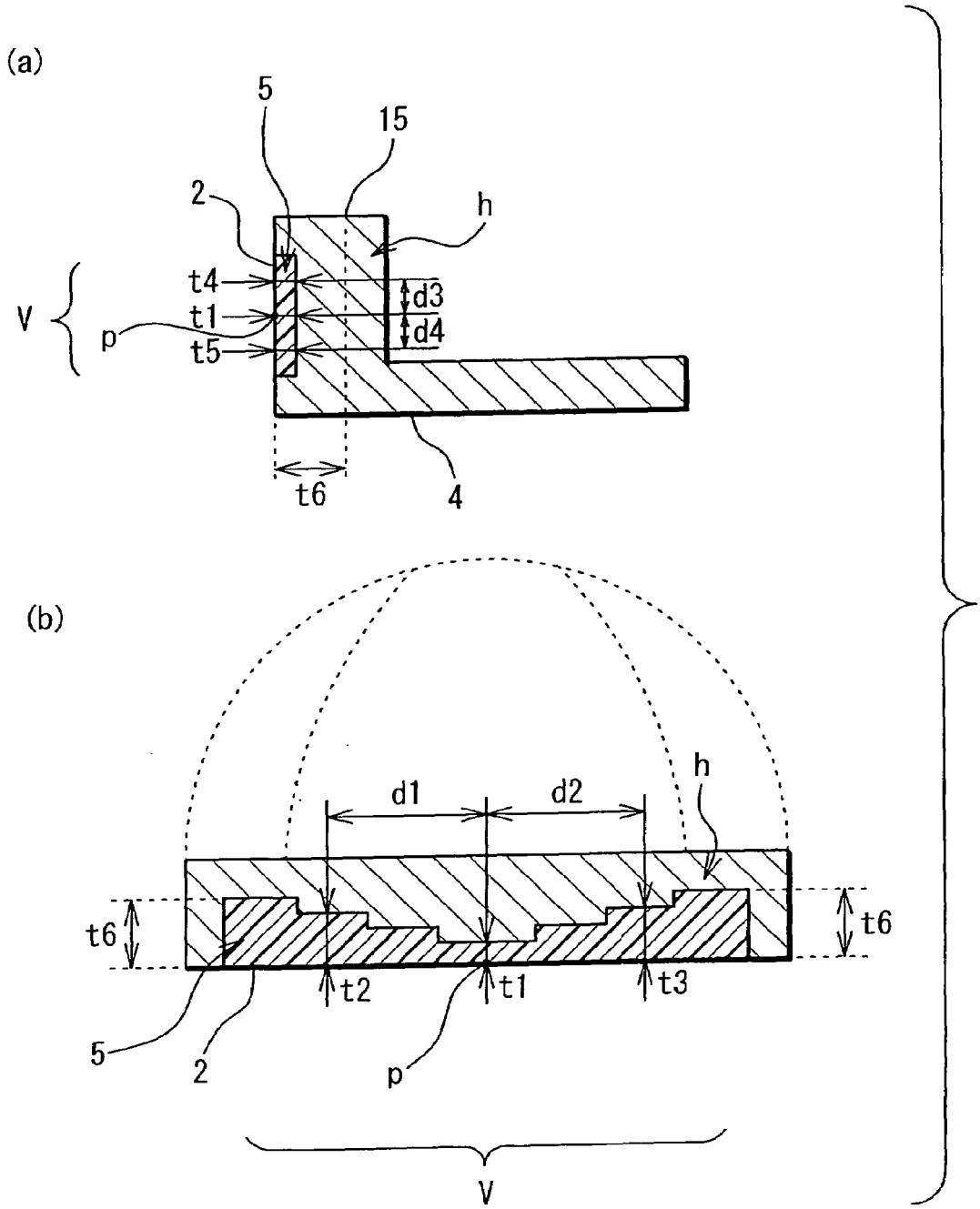
FIG. 7 is a group of sectional views showing a head of a golf putter according to a third embodiment of the invention, FIG. 7(*a*) representing a sectional view taken on the line A—A in FIG. 4, FIG. 7(*b*) representing a sectional view taken on the line B—B in FIG. 4.
Figure 8:
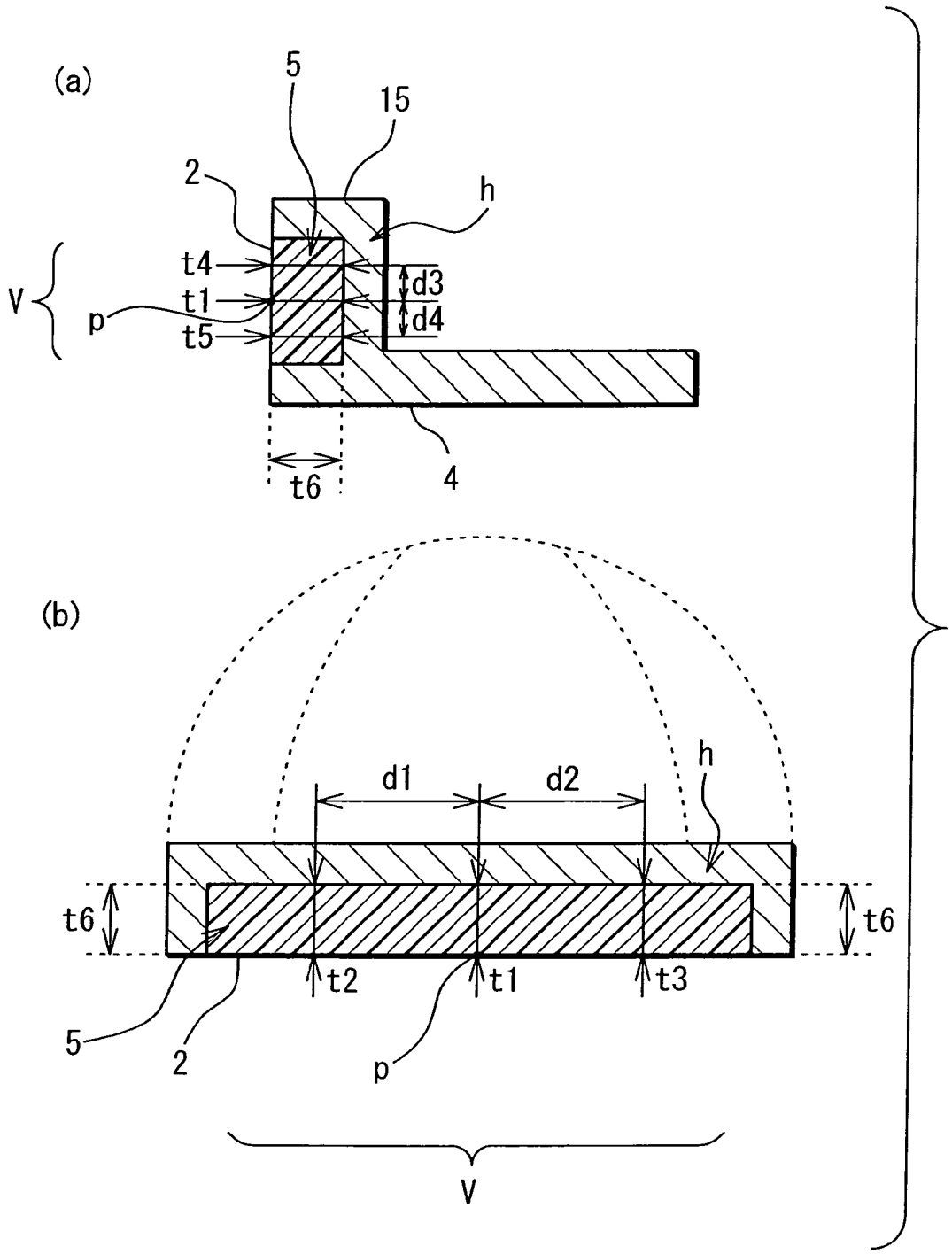
FIG. 8 is a group of sectional views showing a head of a golf putter according to a comparative example, FIG. 8(*a*) representing a sectional view taken on the line A—A in FIG. 4, FIG. 8(*b*) representing a sectional view taken on the line B—B in FIG. 4.

It is noted that FIG. 5(*b*) as well as FIG. 6(*b*), FIG. 7(*b*) and FIG. 8(*b*) to be described hereinlater are sectional views taken on the line B—B in FIG. 4. These sectional views depict only a section of the front portion 13 out of the section of the head 3 in the interest of simplicity of illustration and hence, a section of the rear portion 14 is dispensed with. As a replacement of the omitted section of the rear portion 14, the profile of the rear portion 14 as seen in plan is depicted with a broken line.

The face insert 5 of the golf putter 1 according a first embodiment of the invention as a whole does not have a constant thickness. That is, the face insert is varied in thickness along the toe-heel direction. As shown in the sectional view of FIG. 5(*b*), the thickness of the face insert 5 is the smallest at the center thereof with respect to the toe-heel direction, and is continuously increased toward the toe side and the heel side thereof. The thickness variation ranges from a minimum thickness point p on the putter face 2 corresponding to the thinnest part of the face insert 5 to a toe-side edge and to a heel-side edge of the face insert 5. That is, the thickness of the face insert 5 is the smallest at the minimum thickness point p and is continuously increased therefrom toward the toe-side edge and the heel-side edge of the face insert 5, at which the face insert 5 is thickest.

Such thickness variations may be implemented in the following configuration. Specifically, one side of the face insert 5 is formed of a substantially flat surface constituting a part of the putter face 2, whereas the back side (the opposite side from the putter face 2) of the face insert 5 is formed of a curved surface convexed toward the putter face 2. Consequently, the aforementioned thickness variations are provided.

The thickness of the face insert 5 is thus varied with respect to the toe-heel direction, whereas the thickness thereof with respect to the top-sole direction is not varied or constant, as shown in FIG. 5(*a*). That is, the face insert 5 according to the embodiment is varied in thickness only in the toe-heel direction.

While FIG. 5(*b*) is the sectional view taken on the line B—B in FIG. 4, as mentioned supra, any sectional view of the face insert 5 with respect to the toe-heel direction has the same shape as that of FIG. 5(*b*), as taken at any position in the face insert 5 with respect to the top-sole direction.

The minimum thickness point p shown in FIG. 5(*a*) and FIG. 5(*b*) is a point on the putter face 2 in correspondence to the thinnest part of the face insert 5, as described above. However, the face insert according to the embodiment shown in FIG. 5 is not varied in thickness with respect to the top-sole direction and hence, the thickness of the face insert 5 is decreased to the minimum at a plurality of points on a straight line rather than at one point. The straight line is located centrally of the toe-heel length of the face insert 5 and extends along the top-sole direction (indicated by a broken line in the face insert 5 shown in FIG. 4). Thus, in a case where the face insert 5 includes a set of minimum thickness points on the line rather than one minimum thickness point, it is assumed that the minimum thickness point p is defined by a point dividing the line into halves. In a case where the face insert 5 includes a plural number of minimum thickness points scattered in an area, the minimum thickness point p is defined by a center point of the area.

According to the embodiment, the minimum thickness point p substantially corresponds to the center point (centroid) of the putter face 2 as well as to the center point (centroid) of the face insert 5 in the putter face 2 (see FIG. 4).

According to the embodiment, the minimum thickness point p does not correspond to the position of a sweet spot SS. As shown in FIG. 4, the sweet spot SS is shifted from the minimum thickness point p toward the toe side and to the sole side (lower side). However, the minimum thickness point p is located in a zone k adjacent the sweet spot (a cross-hatched circular zone shown in FIG. 4) As shown in FIG. 5(*b*), the embodiment includes a varied thickness portion V extending across the face insert 5 or ranging from the toe-side edge to the heel-side edge thereof, the varied thickness portion wherein the thickness of the face insert 5 is increased from the zone k adjacent the sweet spot toward the circumferential edges thereof.

The JIS-A hardness of the face insert 5 is in the range of 88 to 96. A face insert having a hardness out of this range may provide too hard or soft a hit feel, whereas the face insert having the hardness in this range is preferred because a moderately soft hit feel may be obtained. As described in the foregoing, the hardness in this range provides conditions wherein there is a great difference between the hit feel related to the impact on the zone k adjacent the sweet spot and the hit feel related to the impact on place away from the zone k adjacent the sweet spot. Accordingly, the application of the invention to the face insert 5 having the hardness in this range is quite significant. In this sense, as well, it is preferred to specify the JIS-A hardness to range from 88 to 96. For the same reason, it is more preferred to specify the JIS-A hardness to range from 90 to 96.

As to thicknesses at individual points in the face insert 5, a thickness at the minimum thickness point p is expressed as t1; a thickness at a point 20 mm toward the toe side from the minimum thickness point p is expressed as t2; and a thickness at a point 20 mm toward the heel side from the minimum thickness point p is expressed as t3, as shown in FIG. 5(*b*). Distances d1 and d2 shown in FIG. 5(*b*) are both as long as 20 mm.

Values of (t2/t1) and (t3/t1) are both defined to range from 1.2 up to 11 (inclusive). If these values are too small, thickness variations are too small to attain the aforementioned effect to level off the different hit feels. If these values are too great, the thickness t1 at the minimum thickness point p may be too small or the aforesaid thickness t2 or t3 may be too great. In the case where the thickness t1 is too small, the insert 5 may suffer an insufficient strength at the minimum thickness point p, or the impact on the minimum thickness point p may provide an excessively hard hit feel. In the case where the thickness t2 or t3 is too great, there arises a need to increase the depth of the cavity, via which the face insert 5 having such a great thickness is embedded in the head body h. This may lead to a problem that the degree of freedom in designing the head 3 is excessively lowered or that the head body h is so large that the head 3 has an overweight. From this view point, the values of (t2/t1) and (t3/t1) are preferably 1.5 or more and 5 or less, or more preferably 2 or more and 3 or less.

The thickness t1 at the minimum thickness point p may preferably be 1.5 mm or more and 4.5 mm ore less. If the thickness is less than 1.5 mm, the impact on the minimum thickness point p tends to provide an excessively hard hit feel. If the thickness is more than 4.5 mm, the impact on the minimum thickness point p tends to provide an excessively soft hit feel.

The thickness t2 at the point 20 mm toward the toe side from the minimum thickness point p and the thickness t3 at the point 20 mm toward the heel side from the minimum thickness point p may preferably be 3 mm or more and 9 mm or less. If the thickness is less than 3 mm, the impact on the point 20 mm toward the toe or heel side from the minimum thickness point p tends to provide an excessively hart hit feel. If the thickness exceeds 9 mm, the impact on the point 20 mm toward the toe or heel side from the minimum thickness point p tends to provide an excessively soft hit feel.

The golf putter 1 of the aforementioned configuration affords the following effects.

The face insert 5 fixed in the head 3 includes the varied thickness portion V wherein the thickness is increased from the zone k adjacent the sweet spot toward the toe-side edge and the heel-side edge of the face insert 5. In the case where the face insert 5 includes no varied thickness portion V thus having a constant thickness, as described above, the impact on place away from the zone k adjacent the sweet spot provides a much harder hit feel than the impact on the zone k adjacent the sweet spot. Hence, there is a great difference between the hit feels. As the impact point is spaced farther away from the sweet spot, the hit feel becomes harder. In the case of the face insert having the constant thickness, therefore, there occurs a significant difference between the hit feels related to the individual impact points at different distances from the zone k adjacent the sweet spot.

In contrast, the embodiment includes the varied thickness portion V wherein the thickness of the face insert 5 is increased from the zone k adjacent the sweet spot along the toe-heel direction and hence, the difference between the hit feels is cancelled by the difference between the thicknesses of the face insert 5. Thus is reduced the difference between the hit feels related to the individual impact points at different distances from the zone k adjacent the sweet spot. Particularly reduced is the difference between the hit feel related to the impact point in the zone k adjacent the sweet spot and the hit feel related to the impact point shifted from the zone k adjacent the sweet spot along the toe-heel direction. Furthermore, since the minimum thickness point p is located in the zone k adjacent the sweet spot related to the particularly soft hit feel, the differences of the different hit feels are notably reduced. Thus, the different hit feels are leveled off in correspondence to the shift of the impact point along the toe-heel direction. Furthermore, since the varied thickness portion V extends across the face insert 5 or between the toe-side edge and the heel-side edge thereof, the aforesaid effect to level off the different hit feels covers the overall face insert 5.

In addition, the values of (t2/t1) and (t3/t1) are defined to be 1.2 or more and hence, an adequate effect to level off the different hit feels, as the result of varying the thickness, may be exhibited. On the other hand, the values of (t2/t1) and (t3/t1) are defined to be 11 or less and hence, the thickness t1 is prevented from becoming too thin or the thickness t2, t3 is prevented from becoming too thick. Therefore, the degree of freedom of head design is not lowered excessively. As described above, the values of (t2/t1) and (t3/t1) are preferably in the range of 1.5 to 5, or more preferably of 2 to 3.

FIG. 6 is a group of sectional views of the head 3 of a golf putter 1 according to a second embodiment of the invention. Likewise to FIG. 5(*a*) and FIG. 5(*b*) illustrating the first embodiment of the invention, the sectional views are taken on the line A—A and the line B—B in FIG. 4.

The thickness of the face insert 5 according to the second embodiment is varied not only in the toe-heel direction as in the first embodiment shown in FIG. 5, but also in the top-sole direction. That is, the thickness is increased from the zone k adjacent the sweet spot toward a top-side edge and a sole-side edge of the face insert 5. Therefore, when the impact point is shifted from the zone k adjacent the sweet spot along the top-sole direction, as well, the different hit feels may be leveled off.

The thickness variations of the varied thickness portion V with respect to the top-sole direction continue to the top-side edge and to the sole-side edge of the face insert 5. Therefore, the effect to level off the different hit feels covers the overall face insert 5.

In order to establish such a thickness distribution, the face insert 5 of the second embodiment is configured such that a side thereof on the putter face 2 is formed of a substantially flat surface whereas the opposite side thereof from the putter face 2 is substantially in the form of an elongated sphere.

It is noted here that a thickness of the face insert 5 at a point 5 mm toward the top side from the minimum thickness point p is expressed as t4, while a thickness thereof at a point 5 mm toward the sole side from the minimum thickness point p is expressed as t5. Distances d3 and d4 shown in FIG.

5(*b*) are both as long as 5 mm. According to the second embodiment, values of (t4/t1) and (t5/t1) are both in the range of 1.1 to 3. If these values are too small, thickness variations are so small as to result in a reduced effect to level off the different hit feels related to the impact points shifted from the zone k adjacent the sweet spot toward the top or toward the sole. If these values are too great, the thickness t1 at the minimum thickness point p may become too thin or the aforesaid thickness t4 or t5 may become too thick, just as in the case of the values of (t2/t1) and (t3/t1). From this view point, the values of (t4/t1) and (t5/t1) are more preferably in the range of 1.2 to 3, or even more preferably of 1.2 to 2.5.

On the other hand, the thicknesses t4 and t5 may preferably be in the range of 2 mm to 5 mm. If the thickness is less than 2 mm, the impact on a point 5 mm toward the top or sole side from the minimum thickness point p tends to provide an excessively hard hit feel. If the thickness exceeds 5 mm, the impact on a point 5 mm toward the top or sole side from the minimum thickness point p tends to provide an excessively soft hit feel.

According to a third embodiment of the invention shown in FIG. 7, the thickness is varied along the overall toe-heel length just as in the first embodiment shown in FIG. 5. However, the thickness variations are not in the continuous form as in the first embodiment. This embodiment includes steps so as to vary the thickness stepwise. Thus, the thickness variations are not limited to the continuous from but the stepwise thickness variations may also be provided. An alternative configuration may be made such that the stepwise thickness variations are provided not only in the toe-heel direction but also in the top-sole direction.

It is noted here that the aforesaid toe-heel direction and the top-sole direction are defined as follows.

First, a reference set position of the golf putter 1 is defined. The golf putter 1 is placed on a horizontal plane with its lie angle α (see FIG. 1) set to 71° to the horizontal plane. A position of the golf putter 1 with its head 3 stably positioned at such a lie angle is defined as the reference set position of the golf putter 1. A direction of a line where a plane including the putter face 2 of the head 3 in the reference set position intersects the horizontal plane is defined as the toe-heel direction. On the other hand, a direction perpendicular to the horizontal plane (or vertical direction) is defined as the top-sole direction. The lie angle α is set to 71° because a lie angle α for common putters is in the range of 70° to 72°, a median value of which is adopted.

It is assumed in this application that in a case where the putter face 2 is not formed of a flat surface, "the putter face 2" is replaced by a plane interconnecting three points in total which include two points at the opposite ends of a leading edge of the head 3 and a point centrally of a top line of the head 3.

In addition, a direction perpendicular to both the toe-heel direction and the top-sole direction is defined as a face-back direction.

The thickness (the thicknesses t1 to t5 and such) of the face insert 5 is measured along the face-back direction.

Figure 9:
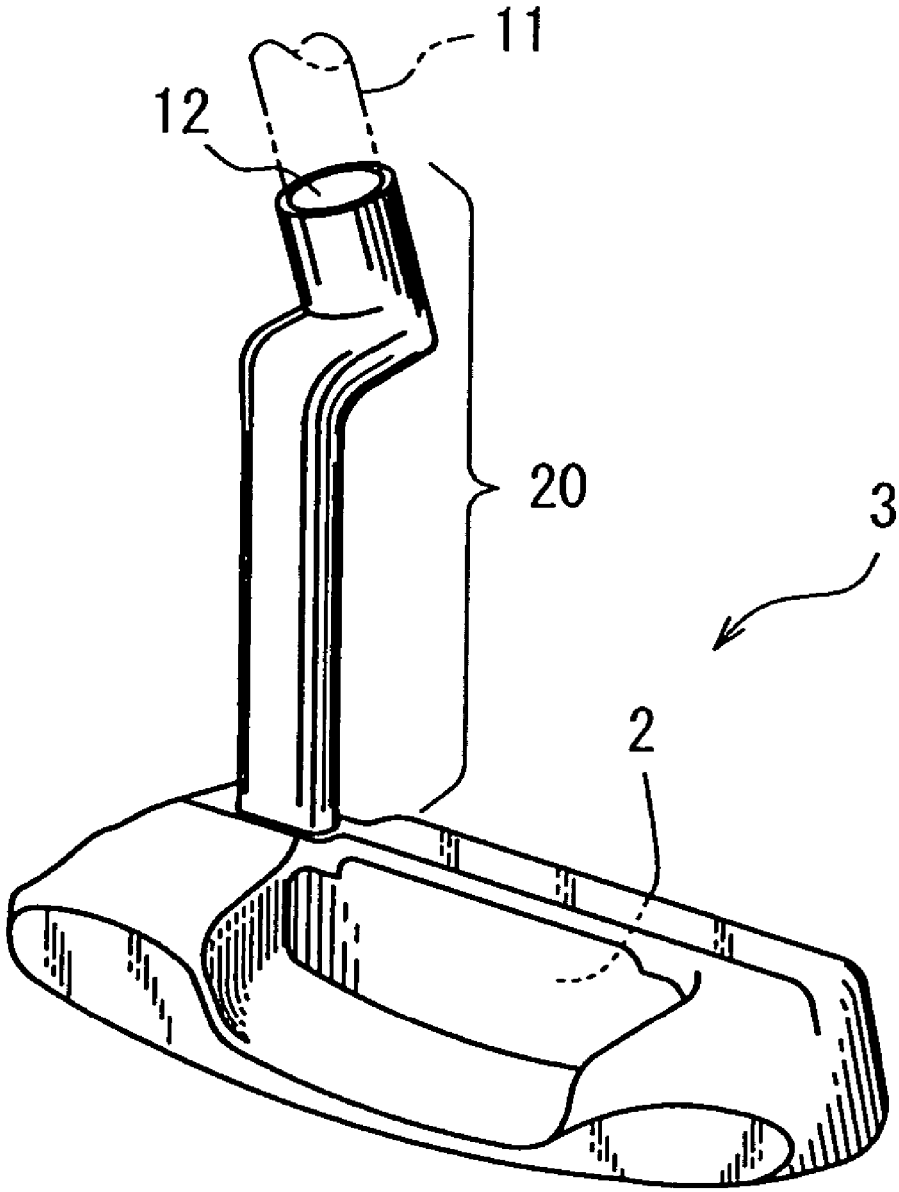
FIG. 9 is a perspective view showing a putter head including a neck.

The sweet spot SS is defined by a point of intersection of a line extending through a centroid g (not shown) of the head 3 and perpendicular to the putter face 2, and the putter face 2. In a case where the head 3 includes a neck, however, a centroid of the head exclusive of the neck is defined as the aforesaid centroid g, based on which the sweet spot SS is defined. According to the first to third embodiments, the head 3 does not include the neck and hence, the sweet spot SS may be defined based on the centroid g of the head 3 per se. In a case where the head 3 includes a neck 20 as shown in FIG. 9, for example, the sweet spot SS is defined by a point of intersection of a line extending through a centroid of the head exclusive of the neck 20 and perpendicular to the putter face 2, and the putter face 2.

The sweet spot SS is defined in this manner for the following reason.

As described above, the hit feel upon impact on the zone k adjacent the sweet spot SS is softer than the hit feel upon impact on place away from the zone k. In the case of the head including the neck, the neck may be considered as an equivalent to the shaft 11 because the neck is projected from the head 3 and fixed in a way just like the shaft 11 fixed to the head 3. In other words, the neck is not considered as a part of the head 3 but as the equivalent to the shaft 11. Accordingly, it is thought proper to determine the centroid of the head 3 based on the head portion exclusive of the neck.

In a case where the sweet spot SS based on the above definition does not exist on the putter face 2, there may be determined a point of intersection (a phantom sweet spot) of a line through the centroid g of the head (the centroid of the head portion exclusive of the neck in a case where the head includes the neck) and perpendicular to the putter face 2, and a plane including the putter face 2. Then, a point on the putter face 2 that is the closest to the phantom sweet spot may be defined as the sweet spot SS.

According to the invention, the dimensions of the face insert 5 in the putter face 2 may preferably be specified as follows. A toe-heel width w5 of the face insert 5 (see FIG. 4) is preferably 50 mm or more, or more preferably 60 mm or more. If the width w5 is too small, the insert 5 may be smaller than a toe-heel range of a striking point of a common player, involving a higher possibility of the striking point deviating from the face insert 5. Furthermore, the width w5 is preferably 130 mm or less, or more preferably 100 mm or less. If the width w5 is too great, the head body h is increased in size so that the head 3 is more likely to have an overweight.

A top-sole height h5 of the face insert 5 is preferably 100 mm or more and 25 mm or less. If the height h5 is too small, the insert 5 may be smaller than a top-sole range of the striking point of the common player, involving a higher possibility of the striking point deviating from the face insert 5. If the height h5 is too great, the head body h is increased in size so that the head 3 is more likely to have an overweight.

A toe-heel width wf of the putter face 2 of the head body h is preferably 60 mm or more, or more preferably 80 mm or more. If the width wf is too small, it may be difficult to fix the face insert 5 having the aforesaid preferred width w5 in the putter face. Furthermore, the head 3 may be too small in weight. On the other hand, the width wf is preferably 150 mm or less, or more preferably 130 mm or less. If the width wf is too great, the head 3 may have an overweight.

A top-sole height hf of the putter face 2 of the head body h is preferably 15 mm or more and 30 mm or less. If the height hf is too great, it is more likely that the head 3 has an overweight. If the height hf is too small, it may be difficult to fix the face insert 5 having the aforesaid preferred width w5 in the putter face. Furthermore, the head 3 may be too small in weight.

A material of the face insert 5 may be any elastic material. For instance, a suitable material may be selected from resins, rubbers, elastomers and the like. The resin is particularly preferred from the view point of moldability or workability.

A suitable resin includes, for example, thermoplastic resins and thermosetting resins. Specific examples of the suitable resin include a variety of resins such as urethane resins, epoxy resins, polyester resins, ionomer resins and hydrogenated SBRs. Among these, a thermoplastic polyurethane resin "XN-2002" commercially available from NIPPON POLYURETHANE INDUSTRY CO. LTD is particularly preferred because this resin has a proper hardness (JIS-A hardness of 90 degrees) and provides a moderately soft hit feel.

A material of the head body h may be any metal, which include, for example, stainless steel, titanium, titanium alloys, aluminum, aluminum alloys, steel, iron, copper, brass and the like. The material may also be a complex material containing plural types of metals. What is required is that a major part of the head body h is formed of metal. That is, the head body h may partially contain a non-metal material.

A variety of methods may be contemplated for forming the face insert 5 and for fixing the face insert 5 in the head body h. For instance, the face insert 5 may be formed by a cast molding process wherein a material of the face insert 5 is cast in a face cavity in the head body h. The face insert 5 may be formed in a desired shape by injection molding or machining (cutting) and then, be bonded to the head body h by means of an adhesive, a double-sided adhesive tape or the like. Alternatively, a sheet material formed by extrusion may be machined (cut) into a desired shape and then, be bonded to the head body h.

In a case where the molding process is adopted, in particular, the molding process may preferably be followed by machining the overall surface of the putter face 2 for smoothing (flattening) so as to ensure the smoothness of the face insert 5 fixed in the putter face 2.

The thickness of the face insert 5 may preferably be varied in a similar form to the profile of the putter face 2. Specifically, a contour line at each thickness of the face insert 5 may preferably define a similar shape to the profile of the putter face 2. This approach provides easy correspondence between the varied thickness of the face insert 5 and the distance from the zone k adjacent the sweet spot. Hence, the effect to level off the different hit feels is enhanced even further.

EXAMPLES

The effect of the invention was confirmed by examining examples of the invention and comparative examples. There were fabricated seven types of golf putters as Examples 1 to 7, whereas two types of golf putters were fabricated as Comparative Examples 1 and 2. A test was conducted using these golf putters.

Specifications common to all the heads of Examples 1 to 7 and Comparative Examples 1, 2 are listed as below. All the heads 3 had a common general configuration which is shown in FIG. 2 to FIG. 4. The putter face 2 had a toe-heel width wf of 110 mm and a top-sole height hf of 25 mm. The head 3 had a toe-heel maximum width of 110 mm which was equal to the width wf, and a top-sole maximum height of 25 mm which was equal to the height hf. As to the dimensions of the face insert 5 in the putter face 2, a top-sole height h5 was 20 mm whereas a toe-heel width w5 was 100 mm. All the golf putters employed a common grip and shaft, and had the same head weight and the same total club weight. The face insert 5 was formed from a thermoplastic polyurethane resin "XN-2002" commercially available from NIPPON POLYURTHANE INDUSTRY CO. LTD. The head body h was formed from SUS630 by lost wax precision casting. The face insert 5 was bonded to the head body h by means of an adhesive. The face insert 5 was formed by punching out a desired shape from a commercially available sheet material and machining the punched sheet as required so as to vary the thickness thereof.

The results of the test on the golf putters of the examples and comparative examples are listed in the following table 1.

TABLE 1

| | Examples | | | | | | | C. Examples | |
|---|---|---|---|---|---|---|---|---|---|
| | 1 | 2 | 3 | 4 | 5 | 6 | 7 | 1 | 2 |
| Thickness t1(mm) | 4.0 | 2.0 | 1.0 | 5.0 | 5.0 | 6.0 | 4.0 | 4.0 | 9.0 |
| Thickness t2(mm) | 6.0 | 6.0 | 7.0 | 10.0 | 6.0 | 6.6 | 6.0 | 4.0 | 9.0 |
| Thickness t3(mm) | 6.0 | 6.0 | 7.0 | 10.0 | 6.0 | 6.6 | 6.0 | 4.0 | 9.0 |
| Thickness t4(mm) | 4.0 | 2.0 | 1.0 | 5.0 | 5.0 | 6.0 | 4.8 | 4.0 | 9.0 |
| Thickness t5(mm) | 4.0 | 2.0 | 1.0 | 5.0 | 5.0 | 6.0 | 4.8 | 4.0 | 9.0 |
| Thickness t6(mm) | 8.0 | 10.0 | 11.0 | 12.0 | 7.5 | 7.0 | 8.0 | 4.0 | 9.0 |
| (t2/t1) and (t3/t1) | 1.5 | 3.0 | 7.0 | 2.0 | 1.2 | 1.1 | 1.5 | 1.0 | 1.0 |
| (t4/t1) and (t5/t1) | 1.0 | 1.0 | 1.0 | 1.0 | 1.0 | 1.0 | 1.2 | 1.0 | 1.0 |
| Thickness variation mode | FIG. 5 | FIG. 5 | FIG. 5 | FIG. 7 | FIG. 5 | FIG. 5 | FIG. 6 | FIG. 8 | FIG. 8 |
| Hit feel SS | 8.3 | 7.4 | 6.5 | 8.7 | 8.6 | 8.9 | 8.4 | 8.5 | 9.6 |
| Hit feel toe-heel | 7.5 | 8.0 | 8.2 | 9.6 | 7.2 | 6.9 | 7.4 | 5.2 | 7.8 |
| Hit feel top-sole | 6.4 | 5.7 | 4.8 | 7.1 | 7.0 | 6.4 | 7.2 | 6.4 | 7.5 |
| Hit feel difference A | 0.8 | 0.6 | 1.7 | 0.9 | 1.4 | 2.0 | 1.0 | 3.3 | 1.8 |
| Hit feel difference B | 1.9 | 1.7 | 1.8 | 1.6 | 1.6 | 2.5 | 1.2 | 2.1 | 2.1 |
| Sense of roll distance(cm) | 56 | 66 | 82 | 64 | 68 | 87 | 50 | 102 | 100 |

In the table 1, the "thicknesses t1–t5" denote thicknesses at the individual points described in the foregoing embodiments. The "thickness t6" denotes a maximum thickness of the face insert 5.

The "thickness variation mode" indicates a figure illustrating a mode of varying the thickness of the face insert 5 of each of the examples and comparative examples. The face insert of Example 1, for example, has the configuration shown in FIG. 5 wherein the thickness is continuously varied along the overall toe-heel length thereof whereas the thickness with respect to the top-sole direction is not varied. The face insert 5 of Comparative Examples 1, 2 is not varied in thickness as indicated by the sectional views of FIG. 8. Thus, the whole body of the face insert has a constant thickness.

In the table 1, the "hit feel SS" denotes an average of the evaluation points (up to 10 points) given by 10 low handicap (handicap 0–9) golfers as testers who each struck (putted) a ball at the zone k adjacent the sweet spot and evaluated the hit feel. The higher evaluation value means the accordingly softer hit feel. The "hit feel toe-heel" denotes an average of the evaluation points (up to 10 points) given by the aforesaid 10 low handicap (handicap 0–9) golfers who each struck balls at the point 20 mm toward the toe from the minimum thickness point p and at the point 20 mm toward the heel therefrom and then evaluated the hit feels upon impact on the respective points. In this case as well, the higher evaluation value means the accordingly softer hit feel. The "hit feel toe-heel" was evaluated based on the same criteria as the aforesaid "hit feel SS".

The "hit feel difference A" denotes an absolute value of ("hit feel SS"−"hit feel toe-heel").

The "hit feel top-sole" denotes an average of the evaluation points (up to 10 points) given by the aforesaid 10 low handicap (handicap 0–9) golfers who each struck balls at the point 5 mm toward the top from the minimum thickness point p and at the point 5 mm toward the sole therefrom and then evaluated the hit feels upon impact on the respective points.

The "hit feel difference B" denotes an absolute value of ("hit feel SS"−"hit feel top-sole").

The "sense of roll distance" denotes an average of the differences between the maximum roll distances and the minimum roll distances of balls putted by 10 middle handicap (handicap 15–25) golfers as follows. Each of the golfers putted 10 balls with each of the putters and then, a difference between a maximum roll distance and a minimum roll distance of the putted 10 balls was determined. When the 10 middle handicap players each putted 10 balls, striking points on the 10 balls varied relatively greatly. Hence, the value of the "sense of roll distance" indicates a difference among the roll distances of the balls struck on the various points of various distances from the zone k adjacent the sweet spot. A putter having the smaller value may be regarded as providing the more consistent sense of roll distance.

The results of the table 1 demonstrate that the varied thickness portions of the examples are effective to reduce the difference of the sense of roll distance. That is, the putters of the examples provide more consistent sense of roll distance than those of the comparative examples.

What is claimed is:

1. A golf putter assembled with a putter head which consists essentially of: a head body formed from a metal; and a face insert which is formed solely from an elastic material and disposed in a putter face of the head body, and which includes a varied thickness portion having a thickness that increases in a direction from a zone adjacent a sweet spot to circumferential edges of said face insert which reduces the difference between hit feel upon impact with a golf ball in the zone adjacent to the sweet spot and hit feel upon impact with a golf ball in a location away from the zone adjacent to the sweet spot.

2. A golf putter as claimed in claim 1, wherein said face insert is positioned to include at least a part of said zone adjacent the sweet spot, and includes a minimum thickness point, as the thinnest part thereof, in said zone adjacent the sweet spot, and said varied thickness portion is varied in thickness along a toe-heel direction of said face insert.

3. A golf putter as claimed in claim 2, wherein said varied thickness portion is varied in thickness along a top-sole direction of said face insert.

4. A golf putter as claimed in claim 3, wherein values of (t4/t1) and (t5/t1) are 1.1 or more and 3 or less, provided that in said varied thickness portion of said face insert, t1 denotes a thickness at said minimum thickness point, t4 denotes a thickness at a point 5 mm toward the top side from said minimum thickness point, and t5 denotes a thickness at a point 5 mm toward the sole side from said minimum thickness point.

5. A golf putter as claimed in claim 3, wherein values of(t4/t1) and (t5/t1) are 1.2 or more and 3 or less, provided that in said varied thickness portion of said face insert, t1 denotes a thickness at said minimum thickness point, t4 denotes a thickness at a point 5 mm toward the top side from said minimum thickness point, and t5 denotes a thickness at a point 5 mm toward the sole side from said minimum thickness point.

6. A golf putter as claimed in claim 3, wherein values of (t4/t1) and (t5/t1) are 1.2 or more and 2.5 or less, provided that in said varied thickness portion of said face insert, t1 denotes a thickness at said minimum thickness point, t4 denotes a thickness at a point 5 mm toward the top side from said minimum thickness point, and t5 denotes a thickness at a point 5 mm toward the sole side from said minimum thickness point.

7. A golf putter as claimed in claim 2, wherein values of (t2/t1) and (t3/t1) are 1.2 or more and 11 or less, provided that in said varied thickness portion of said face insert, t1 denotes a thickness at said minimum thickness point, t2 denotes a thickness at a point 20 mm toward the toe side from said minimum thickness point, and t3 denotes a thickness at a point 20 mm toward the heel side from said minimum thickness point.

8. A golf putter as claimed in claim 2, wherein values of (t2/t1) and (t3/t1) are 1.5 or more and 5 or less, provided that in said varied thickness portion of said face insert, t1 denotes a thickness at said minimum thickness point, t2 denotes a thickness at a point 20 mm toward the toe side from said minimum thickness point, and t3 denotes a thickness at a point 20 mm toward the heel side from said minimum thickness point.

9. A golf putter as claimed in claim 2, wherein values of (t2/t1) and (t3/t1) are 2 or more and 3 or less, provided that in said varied thickness portion of said face insert, t1 denotes a thickness at said minimum thickness point, t2 denotes a thickness at a point 20 mm toward the toe side from said minimum thickness point, and t3 denotes a thickness at a point 20 mm toward the heel side from said minimum thickness point.

10. A golf putter as claimed in claim 1, said face insert having a JIS-A hardness of 88 to 96.

11. A golf putter assembled with a putter head comprising: a head body formed from a metal; and a face insert which is formed from an elastic material and disposed in a putter face of the head body, and which includes a varied thickness portion having a thickness that increases in a direction from a zone adjacent a sweet spot to circumferential edges of said face insert;

wherein said face insert is positioned to include at least a part of said zone adjacent the sweet spot, and includes a minimum thickness point, as the thinnest part thereof, in said zone adjacent the sweet spot;

wherein said varied thickness portion is varied in thickness along a toe-heel direction of said face insert;

wherein the face insert is formed solely from the elastic material;

wherein values of (t4/t1) and (t5/t1) are 1.2 or more and 2.5 or less, provided that in said varied thickness portion of said face insert, t1 denotes a thickness at said minimum thickness point, t4 denotes a thickness at a point 5 mm toward the top side from said minimum thickness point, and t5 denotes a thickness at a point 5 mm toward the sole side from said minimum thickness point; and wherein a cavity configured in conformity with the configuration of the face insert is formed in the putter face of the head body, the face insert is fixedly fitted in the cavity, and a bottom face of the cavity and a back face of the face insert contact with each other.

12. A golf putter as claimed in claim 1, wherein the face insert extends continuously from heel to toe over most of the length of the putter face.

13. A golf putter as claimed in claim 11, wherein the face insert extends continuously from heel to toe over most of the length of the putter face.

* * * * *